United States Patent [19]

Thayer

[11] 4,112,806

[45] Sep. 12, 1978

[54] AXIAL FLOW VALVE

[76] Inventor: Orla E. Thayer, P.O. Box 473, Waldport, Oreg. 97394

[21] Appl. No.: 764,028

[22] Filed: Jan. 31, 1977

[51] Int. Cl.[2] ..... G10D 9/04

[52] U.S. Cl. ..... 84/390

[58] Field of Search ..... 84/387, 388, 390, 391, 84/392, 394, 395, 396

[56] References Cited

U.S. PATENT DOCUMENTS

| | | | |
|---|---|---|---|
| 1,244,745 | 10/1917 | King | 84/391 |
| 1,428,675 | 9/1922 | Alschansky | 84/395 |
| 1,703,411 | 2/1929 | Steinmetz | 84/390 |
| 2,259,756 | 10/1941 | Lindsay | 84/388 |
| 3,780,756 | 12/1973 | Pennington | 137/119 |
| 3,886,837 | 6/1975 | Veneklasen | 84/388 |
| 3,933,078 | 1/1976 | Veneklasen | 84/387 |
| 4,047,459 | 9/1977 | Nakamura | 84/390 |

*Primary Examiner*—Lawrence R. Franklin
*Attorney, Agent, or Firm*—Klarquist, Sparkman, Campbell, Leigh, Hall & Whinston

[57] ABSTRACT

A rotary valve for selectively inserting and removing a slide loop from the sound path of a musical instrument is disclosed. The valve includes a rotor having two sound passages extending therethrough, one of the passages being straight and the other being only slightly curved. These passages align axially with the instrument's lead pipe, main bore, and slide loop ends so that a minimum of undesired harmonics are added to the tone of the instrument due to presence of the valve in the sound path.

2 Claims, 14 Drawing Figures

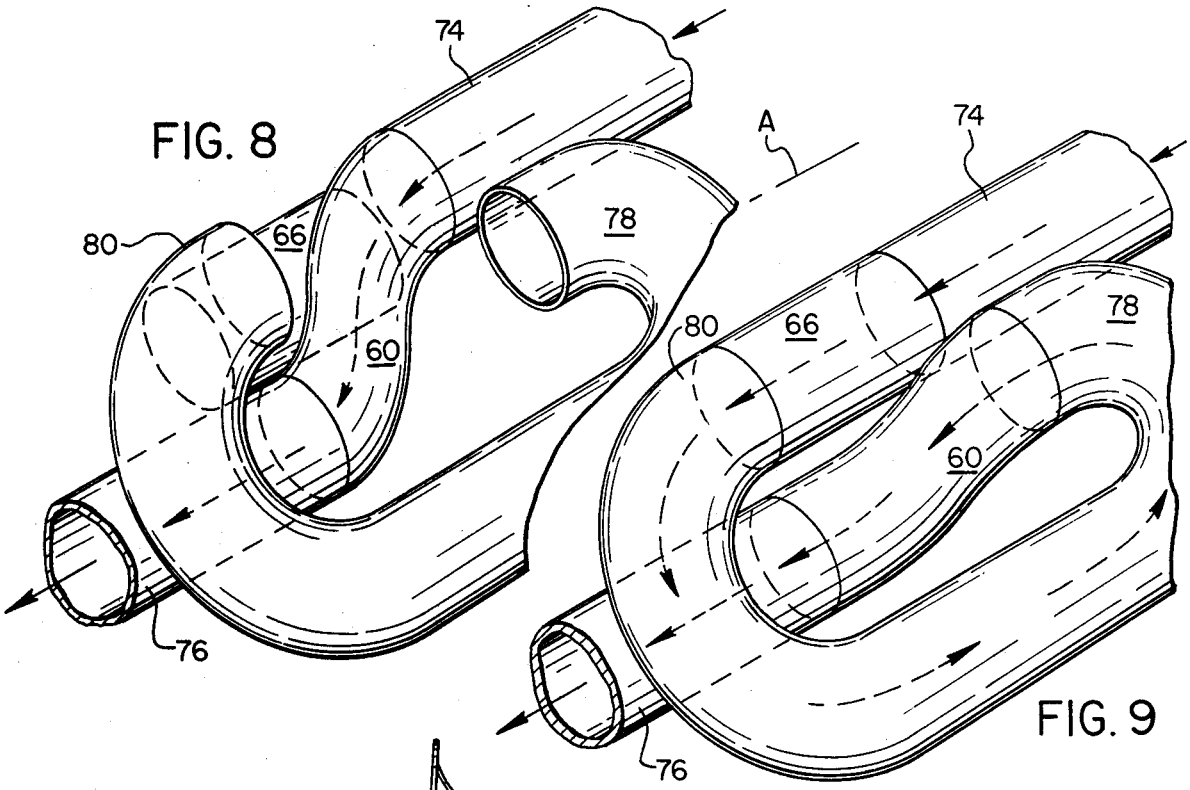
FIG. 8
74
80
66
60
78
76
A
74
80
66
78
60
76
FIG. 9
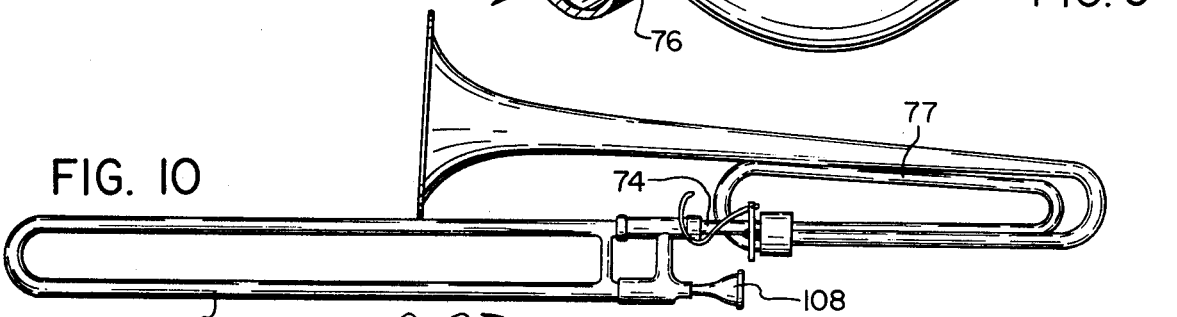
FIG. 10
77
74
108
110
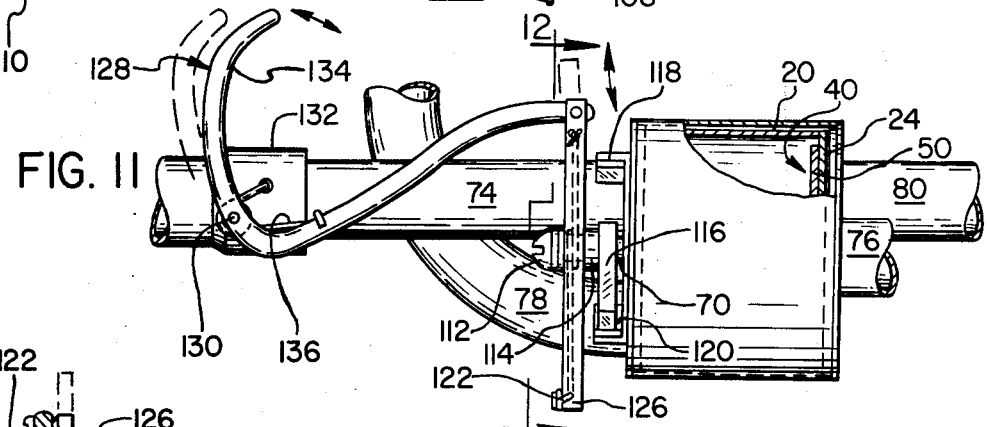
FIG. 11
128
134
132
12
118
20
40
24
50
80
74
116
76
78
70
112
114
120
122
126
130
136
12
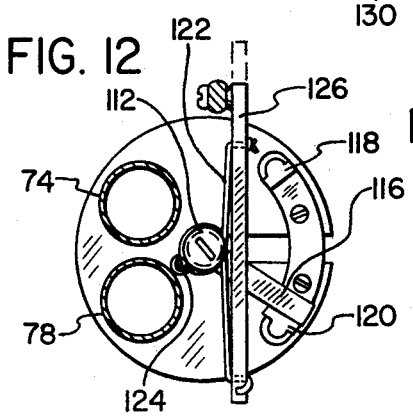
FIG. 12
122
126
112
118
74
116
78
120
124
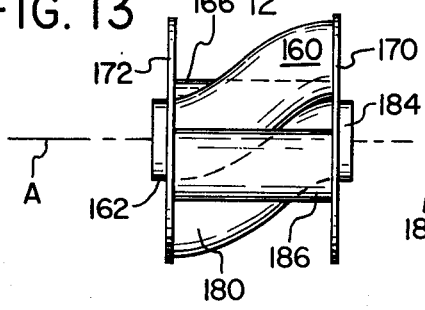
FIG. 13
166
160
170
172
184
A
162
186
180
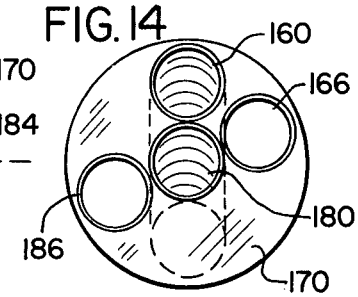
FIG. 14
160
166
180
186
170

AXIAL FLOW VALVE

BACKGROUND OF THE INVENTION

This invention relates to a rotary fluid flow switch and more specifically to a rotary air valve of a musical instrument.

Rotary valves are highly regarded for use in musical instruments due to their quick action and relative simplicity of structure as compared to piston type valves. Prior rotary valves suffer, however, from the disadvantage that they add overtones to the sound of the instrument when played. These overtones are the result of sharp bends in the air passage which occur either inside the valve rotor or at the junction of the valve rotor with the instrument tubing. Whenever the sound waves traveling through an instrument's sound passage are required to make a sharp turn, a certain portion of the waves reflects off the inside walls of the passage. Such a partial reflection reduces the energy of the fundamental wave and produces an undesirable overtone.

SUMMARY OF THE INVENTION

The present invention is a valve which adds substantially fewer unwanted harmonics to an instrument's tone than do prior art valves. The valve is constructed with only two passages, one of which extends straight through the rotor and the other of which curves only slightly. Furthermore, the lead pipe and main bore of the instrument align axially with the passages of the valve rotor so that sound waves enter, pass through, and leave the valve without substantially changing direction or being deflected off of the passage walls.

An object of the invention is to improve the accoustic performance of all common, valved brass wind instruments, such as trumpets, alto horns, single French horns, trombones, baritones and tubas, by providing a valve which does not have the abruptly angled sound passages of prior art rotary and piston valves.

An additional object of this invention is therefore to provide a rotary valve having passages which extend in a substantially straight path therethrough.

Another object is to provide a rotary valve in which the instrument's lead pipe and main bore align axially with the passages through the valve's rotor.

A further object is to provide a rotary valve having a rotor which requires only two passages extending axially therethrough.

A still further object of the invention is to provide a rotary valve having a passage which enters or alternatively departs from the rotor coaxially to its axis of rotation.

Also, it is an object of the present invention to provide a rotary valve which is of simple design, requires a minimum of parts, is inexpensive and easy to construct.

Other objects and advantages of this invention will become apparent to those skilled in the art upon reading the specification.

BRIEF DESCRIPTION OF THE DRAWINGS

FIG. 8 is an isometric schematic view showing the rotor of the valve according to the present invention in a first or direct flow position;

FIG. 9 is an isometric schematic view showing the valve rotor of FIG. 8 in a second or diverted flow position;

FIG. 10 is a side elevation of a B-flat trombone incorporating a valve according to the present invention;

FIG. 11 is a plan view on an enlarged scale of the valve shown in FIG. 10;

FIG. 12 is a vertical sectional view taken along line 12—12 of FIG. 11;

FIG. 13 is a side elevation of a valve rotor according to the present invention for simultaneously engaging two slide loops; and FIG. 14 is an end elevation of the valve rotor shown in FIG. 13.

DESCRIPTION OF THE PREFERRED EMBODIMENT

Figure 1:
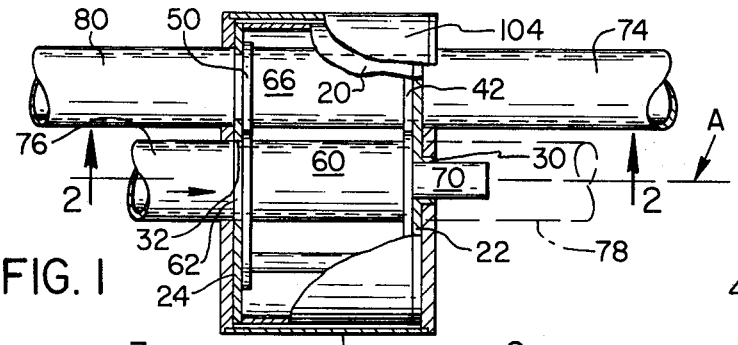
FIG. 1 is a partially broken away top view of a valve according to the present invention.
Figure 5:
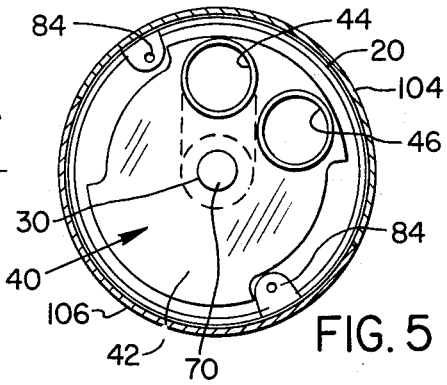
FIG. 5 is a vertical sectional view taken along line 5—5 of FIG. 2.
Figure 2:
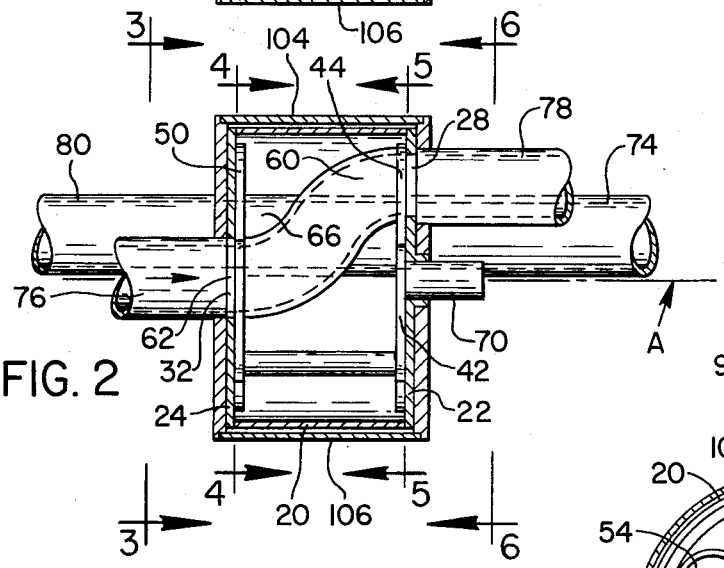
FIG. 2 is a vertical sectional view taken along line 2—2 of FIG. 1.
Figure 6:
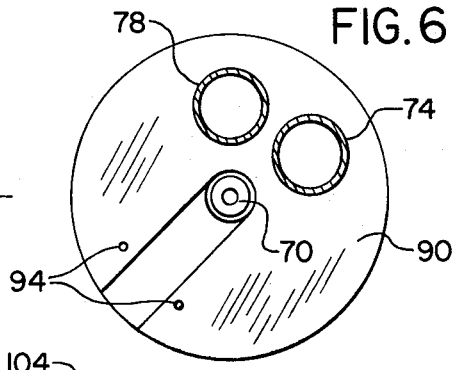
FIG. 6 is a vertical sectional view taken along line 6—6 of FIG. 2.
Figure 3:
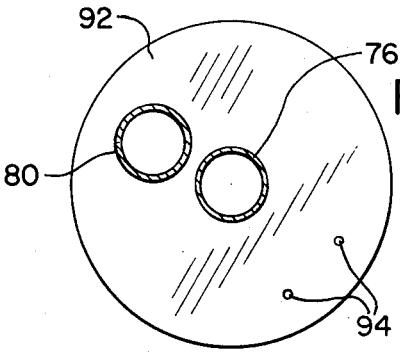
FIG. 3 is a vertical sectional view taken along line 3—3 of FIG. 2.
Figure 4:
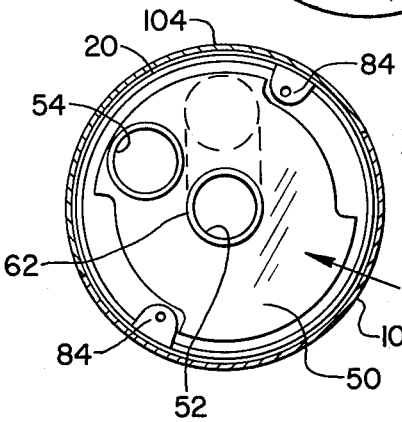
FIG. 4 is a vertical sectional view taken along line 4—4 of FIG. 2.

A valve according to the present invention is shown in FIGS. 1 through 7. This valve has a casing which includes a tubular body 20, a first body end plate 22 fixed on one end of the body and positioned so that its flat surfaces are perpendicular to the longitudinal axis 'A' of the body, and a second body end plate 24 secured on the other end of the body 20 and parallel to the first body end plate 22. The first body end plate 22 defines two body inlet apertures. One of the inlet apertures is a primary body inlet aperture 26 having an axis which is parallel to but displaced from the axis A. The other is a secondary body inlet aperture 28 the center of which is displaced an equal distance away from the longitudinal axis A as is the center of the primary body inlet aperture 26. The first body end plate 22 also includes a circular shaft aperture 30 which is positioned coaxially to the longitudinal axis A. The second body end plate 24 defines two body outlet apertures. One of the outlet apertures is a circular primary body outlet aperture 32 coaxially aligned with the longitudinal axis A of the body 20. The other is a secondary body outlet aperture 34 positioned opposite said primary body inlet aperture 26.

A rotor indicated generally at 40 is located inside the casing. At one end of the rotor 40 is a substantially disc-shaped first rotor end plate 42 having a diameter slightly less than the inside diameter of the body 20. This first rotor end plate is positioned with one of its flat surfaces adjacent the first body end plate 22. The first rotor end plate 42 includes a primary rotor inlet aperture 44 adapted to register alternatively with the primary body inlet aperture when the rotor is in a first position and with the secondary body inlet aperture when the rotor is in a second position. The first rotor end plate also includes a secondary rotor inlet aperture 46 which is positioned to register with said primary body inlet aperture 26 when the rotor is in the second position. The rotor inlet apertures are preferably the same size and shape as the body inlet apertures.

A substantially disc-shaped second rotor end plate 50 having the same diameter as the first rotor end plate 42 is positioned with one of its flat surfaces adjacent the second body end plate 24. The second rotor end plate 50 defines primary and secondary rotor outlet apertures 52 and 54. The primary rotor outlet aperture 52 remains in alignment with the primary body outlet aperture 32 at all times. The secondary rotor outlet aperture 54 registers with the secondary body outlet aperture 34 only when the rotor 40 is in the second position. The secondary rotor outlet apertures and the secondary body outlet apertures are preferably the same size and shape.

In the preferred embodiment a rigid primary rotor tube 60 extends through the primary rotor inlet aperture 44 between the rotor end plates, and through the primary rotor outlet aperture 52. Preferably a cylindrical extension 62 of the primary rotor passage 60 further extends through the primary body outlet aperture 32 so that the extension 62 is journaled within the aperture 32 of the second body end plate 24. A rigid secondary rotor tube 66 extends through the secondary rotor inlet aperture 46 between the rotor end plates and then through the secondary rotor outlet aperture 54. The axis of this preferred secondary rotor tube 66 is perpendicular to the rotor end plates and coaxially to the secondary rotor inlet aperture 46 and the secondary rotor outlet aperture 54. The rotor tubes 60, 66 provide passages for air traveling through the rotor 40. Other rotor constructions could be used. For instance, a solid cylindrical core, having passages extending therethrough, would be equally suitable.

A shaft 70, extending from the outer side of the second rotor end plate 42, is coaxial to the longitudinal axis A. This shaft 70 extends through the shaft aperture 30 so that the rotor can be rotated about the axis A by rotating the shaft 70.

The best tone quality is achieved in a musical instrument if sound waves traveling through its valves encounter a minimum amount of resistance. In the present invention exceptionally low resistance is accomplished by constructing the secondary rotor tube 66 of a straight, rigid piece of tubing which is positioned perpendicular to the rotor end plates. The primary rotor tube 60 is preferably shaped as a slight S-curve and has end portions positioned to be substantially perpendicular to the rotor end plates. By mounting the instrument tubes so that their axes are perpendicular to the rotor end plates at the points where they are mounted on the body end plates, a minimum amount of resistance is encountered during the transfer of sound waves between the instrument tubes and the rotor passages. The specific instrument tubes referred to include a lead pipe which extends from the instrument's mouthpiece to the valve, a main bore which extends from the valve to the instrument's bell, and a slide loop which is a passageway of fixed length connected at each end to the valve and includable by the valve in the sound path of the instrument to change the pitch of tone being played. In most instances such slide loops include a slide which can be moved a short distance to tune the instrument to the proper pitch.

A slightly less desirable alternative to the S-shaped primary rotor tube 60 is a straight tube extending diagonally between the rotor end plates. Although a diagonal tube would be a substantial improvement over the prior art, it would not be as satisfactory as the S-shaped tube, since the ends of a diagonal primary rotor tube would not align axially with the instrument tubes. This would introduce some resistance to the transfer of sound waves between the primary rotor passage and the instrument tubes.

As previously described, the rotor 40 may be rotated between a first position in which the primary rotor inlet aperture 44 registers with the primary body inlet aperture 26 and a second position in which each of the rotor apertures registers with a body aperture.

In the embodiment of FIGS. 1 through 7 a valve according to the present invention is positioned between tubes which correspond to the tubes of a musical instrument. A lead pipe 74 extends from the mouthpiece of the instrument and connects to the primary body inlet aperture 26. A main bore 76 is connected to the primary body outlet aperture 32; and opposite ends 78, 80 of a slide loop 77 connect to the secondary body inlet aperture 28 and the secondary body outlet body aperture 34.

Figure 7:
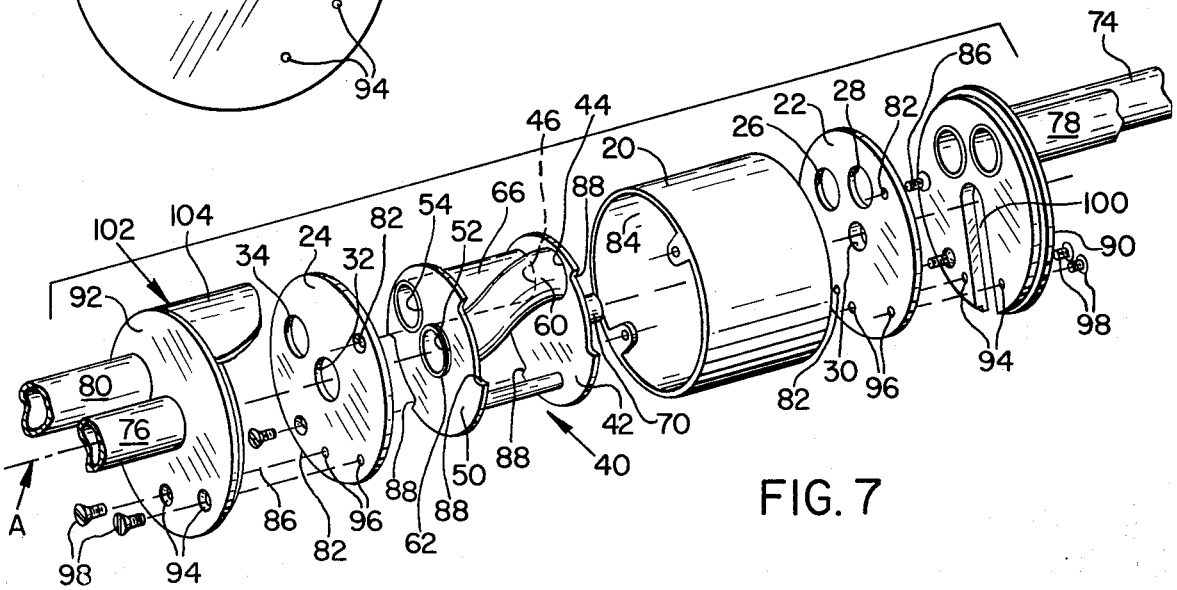
FIG. 7 is an isometric exploded view of the valve shown in FIGS. 1 through 6.

An exploded view of the valve shown in FIGS. 1 through 6 appears in FIG. 7. This figure shows several additional features which are useful when the valve is incorporated into a musical instrument. The body end plates 22 and 24 are provided with screw holes 82. The body 20 is provided with inwardly extending ears 84 having threaded holes. The holes 82 and threaded holes in the ears 84 are adapted to receive screws 86 which secure the body end plates to the body 20. In order for the rotor to rotate inside the body when the end plates are attached in this fashion it is necessary that notches 88 be provided along the edges of the otherwise circular rotor end plates 42, 50.

For easy removal of the valve structure from the musical instrument, mounting plates are permanently attached to the instrument tubes and spaced apart at a distance just sufficient to contain the valve assembly with the body end plates 22, 24 in contact with the plates 90, 92 respectively. The lead pipe 74 and one end 78 of the slide loop 77 are permanently affixed to the mounting plate 90. The main bore 76 and the other end 80 of the slide loop 77 are likewise fixed to the other mounting plate 92. Each mounting plate is provided with a pair of orifices which exactly register with the orifices of the adjacent body end plate when the valve assembly is properly positioned between the mounting plates. With the valve assembly in this position, screw holes 94 in the mounting plates register with threaded screw holes 96 so that screws 98 can secure the valve assembly in position.

The valve assembly is quickly removed from between the mounting plates 90, 92 by unscrewing the screws 98 and sliding the valve assembly from between the mounting plates. A slot 100 is provided in the mounting plate 90 through which the shaft 70 slides as the valve assembly is removed.

A casing cover 102 which surrounds the body 20 and extends between the mounting plates 90, 92 comprises two hemicylindrical segments. One of the segments 104 is permanently mounted on the mounting plates 90, 92. The other segment 106 is removable to expose the valve assembly. By simply removing the screws 98, the entire valve may be removed for servicing. The valve assembly itself may be completely disassembled by removing four additional screws 86.

The rotation of the rotor about the longitudinal axis A is illustrated schematically in FIGS. 8 and 9. FIG. 8 shows the rotor in the normal flow or first position. In this position the primary rotor tube 60 connects the lead pipe 74 directly to the main bore 76.

When the rotor is rotated about the axis A to the second or diverted flow position shown in FIG. 9, the secondary rotor tube 66 connects the lead pipe 74 with one end 80 of the slide loop, and the primary rotor tube 60 connects the other end 78 of the slide loop with the main bore 76. Thus when the valve is in the first position the sound waves can travel directly between the lead pipe 74 and the main bore 76. When the valve is in the second position sound waves must pass through the slide loop 77 when traveling between the lead pipe 74 and the main bore 76.

FIGS. 10 through 13 depict a valve according to the present invention incorporated in a musical instrument. More specifically, FIG. 10 shows a B-flat trombone which includes a single slide loop 77. By rotating the valve, the slide loop 77 may be added to the sound path so that the fundamental pitch of the trombone is lowered to the key of F. The trombone has a mouthpiece 108 and a slide 110 which are portions of the lead pipe 74. The lead pipe connects to primary body inlet aperture of the valve. One end 78 of the slide loop 77 is connected to the secondary body inlet aperture. The other end 80 is connected to the secondary body outlet aperture. The main bore 76 is connected to the primary body outlet aperture.

FIGS. 11 and 12, enlarged view of the preferred valve incorporated in a musical instrument, show a means for rotating the valve shaft and rotor. This rotating means is of the type commonly known as the American string drive. Mounted on the end of the shaft 70 by a screw 112 is a sleeve 114 and a radially extending arm 116. Stops 118, 120 are provided to engage the arm 116. These stops assure positive alignment between rotor apertures and body apertures. A cord 122 is wrapped around the circumference of the sleeve 114 and is secured by a screw 124. Opposite ends of the cord are fixed on opposite ends of a rail 126 with the cord stretched tightly. One end of the rail 126 is pivotally connected to a thumb lever 128. The thumb lever 128 is pivotally mounted, at a pivot point 130, on a collar 132 which is disposed about the lead pipe 74. The lever includes a free end 134 which is manually movable to rotate the valve rotor 40. A spring 136 exerts a downward pressure on the lever 112 at a point between the pivot point 130 and the rail 126 so that the rail is maintained in the lowered position shown by solid lines in FIGS. 11 and 12 unless moved by rotation of the thumb lever 128.

In this embodiment when the rail 126 is in the lowered position, the rotor is in the first or direct flow position shown schematically in FIG. 8. In this position the primary rotor tube 60 directly connects the lead pipe 74 with the main bore 76. When the free end 134 of the lever 128 is pulled away from the valve, the lever 128 pivots about the point 130 so that the rail 126 is lifted to the position shown in broken lines. As the rail moves upwardly, the cord 122 rotates the sleeve 114 which in turn causes the shaft 70 to rotate (counterclockwise in FIG. 12).

When the shaft 70 is fully rotated so that the arm 116 engages the stop 118, the rotor has moved to a position which corresponds to the second or diverted flow position of FIG. 9. In this position the primary rotor tube 60 connects the one end 78 of the slide loop to the main bore 76 while the secondary rotor tube 66 provides a passageway which directly connects the lead pipe 74 with the other end 80 of the slide loop so that the sound path now includes the extra length of the slide loop 77 and the fundamental pitch of the instrument is lowered (in the case of the B-flat trombone, to the key of F).

The efficient operation of valves according to the present invention is not affected by reversing the structure so that the lead pipe 74 is connected to the primary body outlet aperture 32 and the main bore 76 is connected to the primary body inlet aperture 26. Such reversed valves will operate in substantially the same fashion.

Because valves according to the present invention function identically when the lead pipe and main bore are exchanged, it is possible to include an additional pair of rotor tubes and additional sets of rotor and body apertures in a single valve assembly thereby forming a dual valve. This is an important feature of the present invention because certain types of instruments require such dual valves, the most notable being the double French horn and double baritone. In these, the instrument is fitted with two sets of standard valves with their associated slide loops. Each set of valves is provided with properly proportioned slide tube lengths for a specific musical key or pitch. As an example, in the usual double French horn, a primary set of valves may be pitched in the key of F while a secondary set of valves may be pitched in the key of B-flat. An additional diverter valve is provided to direct the sound path through the desired set of valves. In practice each valve is in fact a dual valve which includes two single valves, one from each set, which are linked together so that a single set of finer keys can operate the valves of both the primary and secondary sets.

Beyond this application the dual valve configuration may be utilized in a specific class of instruments called compensating horns. In these it has been found desirable to "compensate" for overall length deficiencies when more than one valve is operated at a time. This is accomplished by providing dual valves to add small secondary slide loops to the sound path, when more than one valve is functioning. Because compensating horns have previously used two standard single valves linked together to make dual valves, such compensating horns have, of necessity, included tortuous sound paths. A dual valve according to the present invention is advantageous in such compensating horns because it includes two single, axial valves in one valve body to simultaneously control the inclusion of both a primary and a secondary slide loop. Such a dual, axial valve reduces the number of valve bodies needed in a compensating horn and also lessens the tortuousness of the horn's sound path.

A rotor according to the present invention for use in such a dual, axial valve is shown in FIGS. 13 and 14. In these figures a primary rotor tube 160, including an extension 162, and a secondary rotor tube 166 correspond to similarly named members of FIGS. 1 through 7. The dual valve rotor additionally includes tertiary rotor tube 180 which extends through the center of a first rotor end plate 170, through the rotor, and then through a peripheral portion of a second end plate 172. An extension 184 of the tertiary rotor tube 180 extends outwardly from a center of the first rotor end plate 170. The extension 184 is adapted to be journaled in a circular tertiary body inlet aperture of an adjacent body end plate so that the extension 184 is coaxial with the axis A. A quaternary rotor tube 186 extends through a peripheral portion of the first rotor end plate 170, between the two rotor end plates, and then through the second rotor end plate 172. The quaternary rotor tube preferably extends straight through the rotor perpendicular to the rotor end plates. The rotor outlets, through which the tertiary and the quaternary rotor tubes extend, have centers which are equidistant from the axis A.

A suitable casing, having four apertures in each body end wall corresponding to the four apertures through each rotor end plate, is necessary for containing the dual valve rotor. Because rotor tube extensions are journaled in axial apertures of both its body end plates, no shaft is available to rotate a dual valve. Other suitable means for rotating the dual valve, such as an arm which is mounted on the rotor and which extends through a slot in the body, must be used. The dual valve operates in the same fashion as the single valve previously described, except that the dual valve allows a musician to simultaneously include or exclude two slide loops by moving the rotor between first and second positions.

While I have shown and described preferred embodiments of my invention, it will be apparent to those skilled in the art that changes and modifications may be made without departing from my invention in its broader aspects.

I claim:

1. A musical wind instrument comprising:

a lead pipe having a mouthpiece at one end thereof;

a main bore terminating in an instrument bell;

a slide loop;

a casing having two opposite ends, said main bore and one end of said loop being connected to one of said opposite ends, said lead pipe and the other end of said loop being connected to the other of said opposite ends;

a rotor rotatable in said casing having a primary rotor passage which directly connects said lead pipe to said main bore when said rotor is in a first position and which connects said lead pipe to said one end of said loop when said rotor is rotated to a second position, said rotor also having a secondary rotor passage which connects said other end of said loop to said main bore when said rotor is in said second position.

2. A musical wind instrument comprising:

a lead pipe having a mouthpiece at one end thereof;

a main bore terminating in an instrument bell;

a slide loop;

a casing having two opposite ends, said lead pipe and one end of said loop being connected to one of said opposite ends, said main bore and the other end of said loop being connected to the other of said opposite ends;

a rotor rotatable in said casing having a primary rotor passage which directly connects said lead pipe to said main bore when said rotor is in a first position and which connects said one end of said loop to said main bore when said rotor is rotated to a second position, said rotor also having a secondary rotor passage which connects said lead pipe to said other end of said loop when said rotor is in said second position.

* * * * *